United States Patent [19]

Novotny et al.

[11] 4,143,468

[45] Mar. 13, 1979

[54] INERT ATMOSPHERE CHAMBER

[76] Inventors: Jerome L. Novotny, 17700 Darden Rd., South Bend, Ind. 46635; Roy S. Nickerson, Sr., 340 Marvel La., New Carlisle, Ind. 46552

[21] Appl. No.: 569,589

[22] Filed: Apr. 18, 1975

Related U.S. Application Data

[60] Division of Ser. No. 462,986, Apr. 22, 1974, which is a continuation of Ser. No. 193,825, Oct. 29, 1971, abandoned.

[51] Int. Cl.[2] ..... F26B 3/34

[52] U.S. Cl. ..... 34/1; 34/4; 34/41; 250/398; 313/111; 313/221

[58] Field of Search ..... 34/1, 4, 41; 204/159.13, 159.11; 313/221, 111; 118/641, 642, 643; 250/398

[56] References Cited

U.S. PATENT DOCUMENTS

| | | | |
|---|---|---|---|
| 3,111,424 | 11/1963 | Le Clair | 427/38 |
| 3,150,281 | 9/1964 | Bishay | 313/221 |
| 3,418,155 | 12/1968 | Colvin et al. | 204/159.11 |
| 3,600,122 | 8/1971 | Coleman | 427/40 |
| 3,676,673 | 7/1972 | Coleman | 250/398 |

*Primary Examiner*—John J. Camby

[57] ABSTRACT

An inert gas chamber for use in continuously curing oxygen sensitive coating compositions by the application of radiation, employs a jet of inert gas to displace the air boundary layer on the coated substrate as the coated substrate moves into the chamber. The coated substrate is also blanketed with inert gas and subjected to the radiation. The use of inert gas to cool the window of the electron beam accelerator may be used in the chamber, thus avoiding ozone-based pollution.

23 Claims, 10 Drawing Figures

3
3

INERT ATMOSPHERE CHAMBER

This is a division of application Ser. No. 462,986, filed Apr. 22, 1974, which in turn is a continuation under Rule 60 of application Ser. No. 193,825, filed Oct. 29, 1971, now abandoned.

The present invention relates to inert atmosphere chambers, and more particularly to inert atmosphere chambers used in connection with continuous, or semi-continuous processes for curing oxygen sensitive coating compositions by the application of radiation including both ionizing radiation and actinic radiation. Still more particularly, the present invention provides an apparatus which is capable of reducing oxygen content of the gas layer at the interface between the atmosphere surrounding the coated substrate and the coating on the substrate. After the oxygen content is reduced in the gas at the interface between the atmosphere and the coating the apparatus of the present invention surrounds the coated substrate with an atmosphere substantially free of unwanted quantities of oxygen, whereby the effects of oxygen inhibition during the polymerization or curing of the coating composition under the influence of the radiation are diminished or obviated.

Various forms of actinic radiation and high energy electron beams have been increasingly used for the radiation of various materials for various purposes. One of the major uses of such radiation devices is to cure coating compositions on various substrates. While it is possible to cure or polymerize some such coating compositions to a tack-free stage in air, it has been found that the presence of a substantial quantity of oxygen in the gas layer immediately adjacent to the coating composition to be cured is undesirable, since the oxygen inhibits the curing or polymerization of the coating composition, causing a condition known in the art as "oxygen inhibition." In some cases "oxygen inhibition" results in coatings which do not cure and remain liquid, but in most cases the oxygen retards the curing of the surface of the film which results in films with tacky surfaces. The prior art has suggested many techniques and apparatus for blanketing the material to be cured with various inert gases. The devices suggested by the prior art have been heretofore commercially unsuccessful, largely because of the economics involved in operating them and their inability to function with a continuous and/or high speed coating and curing production line. Most of the prior art adopted a brute force approach of applying inert gas, which involves filling the entire space surrounding the vicinity of the radiation with large volumes of inert gas, in an effort to push all of the oxygen away from the site of the radiation including a substantial area before and after the site of irradiation. While such devices, when operated at sufficiently high gas volume flow, have been successful from a technical point of view, from a commercial point of view, the volume of gas required is sufficiently high that such devices may not be economically practical. Further, the prior art devices which employ large volumes of inert gas create a potential problem of increasing volatility of the coating, as well as possibly disturbing the surface appearance of the coating due to the high inert gas flow rate across the coated surface. Other approaches suggested by the prior art include vacuum chambers which are suitable for batch operations, but not for continuous operations, and suggest surrounding the film to be cured with vapors of polymerizable monomers. These and other suggestions are found in the following U.S. Pat. Nos. 2,887,584, 3,418,155, 3,440,084, 3,501,390, 3,520,714.

The present invention is based on the discovery that coating compositions can be cured to give good tack-free films if the oxygen level in the gas layer immediately adjacent to the coated surface is markedly reduced, and the composition of this layer is maintained at the reduced oxygen level to the point of irradiation. It has been found that the oxygen level at the interface of the coating surface and the atmosphere is critical, and if it is kept to a suitable low level at the point of irradiation good tack-free cures are obtained.

It has been found that simply moving a coated substrate through an inert atmosphere will not, in of itself, remove or sufficiently reduce the oxygen level at the interface of the coating. It is known to those skilled in the art that when a fluid flows across a surface, or a surface is pulled through a body of fluid, a boundary layer of the fluid exists adjacent to the interface, and that such a boundary layer does not move at the same velocity as the main body of the fluid. Such a boundary layer is believed to exist in the case of a coated substrate moving through an inert atmosphere in that the oxygen content of the boundary layer will be largely maintained (the oxygen will only leave the boundary layer by a slow diffusion process). Thus a coated substrate will take with it a boundary layer containing about 21% oxygen, and carry it through an inert atmosphere where it is available to inhibit curing. Many prior art devices were based on the premise that the oxygen content of the bulk of the atmosphere between the coated substrate and the window of the radiation device was the only oxygen level to be reckoned with. It has now been determined that the presence of oxygen in the boundary layer and more particularly at the interface of the coating and the atmosphere is the prime cause of oxygen inhibition, even though oxygen has been excluded or markedly reduced in the balance of the atmosphere. The present invention is based on the discovery that if the oxygen is removed or markedly reduced from the boundary layer, the presence of oxygen in the rest of the atmosphere is relatively unimportant. Further it has been found that once the oxygen is removed or reduced in the boundary layer being carried by the moving substrate, simply blanketing the substrate with an inert gas which is non-turbulent or laminar in its movement will be adequate to insure a complete tack-free curing of the coating composition, and to eliminate, or at least substantially reduce, the formation of ozone. Although the present invention contemplates the use of a turbulent blanket, it is preferred that the blanket be laminar.

Basically, the apparatus of the present invention is based on the use of an inert gas jet means for displacing the original air boundary layer (containing about 21% oxygen) from the coating composition to be cured, thereby removing the unwanted oxygen from the interface between the atmosphere and the coating composition. In the preferred embodiment a second inert gas jet means is employed for additional blanketing of the substrate with an inert atmosphere. In certain cases, one may use a single nozzle which emits inert gas in a manner which displaces the original air boundary layer and also blankets the substrate with inert gas. Such a single nozzle embodiment can be used depending upon the speed with which the substrate is proceeding through the radiation, the type of product, the configuration of the product, and the chemistry of the coating composition. The chemistry will principally determine the maximum permissible oxygen level. Even in those situations where it is possible to use a single jet means to fulfill the function of both the first jet means and the second jet means, it is essential that the velocity of the inert gas emitted from the jet be sufficient to blow or remove the original air boundary layer, thereby substantially removing the oxygen from the boundary layer. The arrangement of the jet or jets must be such that it removes the required amount of oxygen from the boundary layer in a manner that will not cause unwanted disturbances of the coating on the substrate.

The present invention provides a jet of inert gas which impinges continuously on the surface of the coating composition to be cured, as the coated substrate moves through the jet prior to the point in time at which the substrate reaches the radiation source. The impinging inert gas flow functions in a manner similar to an air knife, whereby it removes the original air boundary layer from the coating composition and literally blows this boundary layer in a direction countercurrent to the movement of the substrate. In so doing, the substrate is effectively washed with an inert gas and the necessary amount of oxygen is driven away from the curing chamber.

Generally speaking, the apparatus used to direct the inert gas on to the substrate is preferably in the form of an elongated nozzle, wherein the elongated portion of the nozzle is transverse to the movement of the substrate being cured. In other words, the nozzle extends across the width of the material which is to be irradiated. In those situations wherein a leading jet and a trailing jet are to be used, it is preferred that the leading jet be angularly disposed whereby the gas emerging from the nozzle has a velocity component opposite to the direction of movement of the substrate.

In the majority of the cases, wherein a plurality of jets are employed, it is preferred that the second nozzle, herein referred to as the trailing jet or nozzle, be similarly elongated, being positioned transverse to the width of the substrate being cured, and closely disposed thereto. The trailing jet may be disposed so as to distribute inert gas in the direction of the substrate's progress as well as counter current to the substrate's movement. The trailing jet performs at least two functions in that it aids the leading jet in removing the air boundary layer and creates a general inert atmosphere to fill the irradiation chamber. This prevents entrapment of oxygen in the boundary layer and avoids oxygen contamination of the inert atmosphere during the curing of the coating.

In another embodiment, inert gas is first used to cool the window of the electron beam apparatus and it is subsequently used to wash the oxygen from the interface of the coating and the atmosphere, and to blanket the substrate. In this embodiment, the window of the electron beam irradiation apparatus is cooled using inert gas rather than air as is described by the prior art. Thereafter the inert gas is directed substantially as described in the normal embodiment. In addition to the obvious advantages of economy, this embodiment substantially reduces the oxygen level in the path through which the electrons travel, and thereby avoids the formation of ozone. Thus this embodiment virtually eliminates a major cause of air pollution.

The invention will be more easily understood by reading the following detailed description in connection with the accompanying drawings, wherein.

Figure 1:
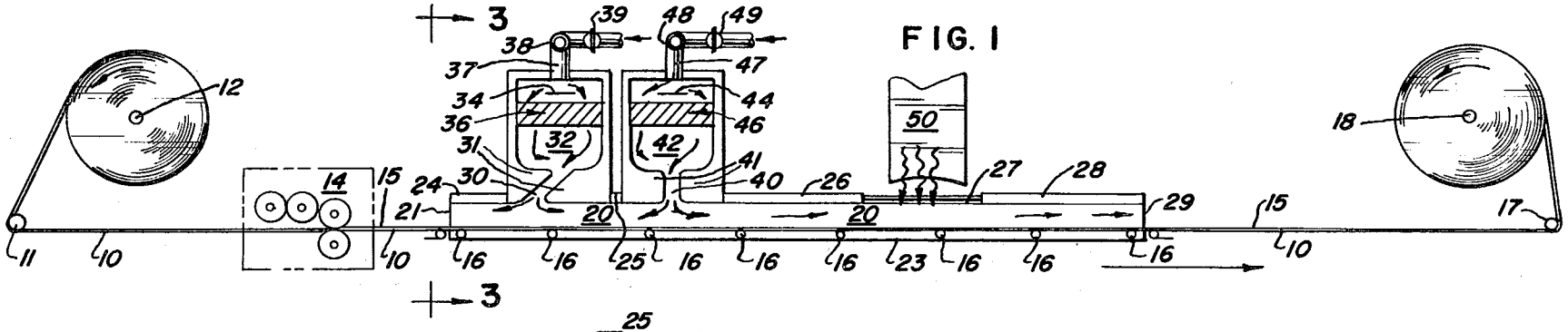
FIG. 1 is a side elevational view of a radiation curing operation schematically illustrating the inert atmosphere chamber of the present invention, with two jets, shown in section, and an electron beam radiation device as the radiation source.

Referring now to FIG. 1, which depicts, rather schematically, a coil coating system for the ionizing radiation curing of a coating composition on a substrate in the form of a coil, in which a supply of substrate 10 to be coated is shown as supported on a reel 12. The substrate 10 is continuously uncoiled and moved through a coating apparatus 14 where the substrate is coated on its upper side with a film 15 of a suitable coating composition. In carrying out the present invention, the coated substrate 10 is moved via carrier means 16 from the coating area into the inert atmosphere chamber shown generally at 20, where the coating is cured by radiation.

FIG. 1 illustrates a coil coating line in which re-wind reel 18 pulls the substrate 10 through the coating device 14, through entrance 21 into the inert chamber 20 and under the radiation source 50. Preferably such a coil coating line is equipped with tension or tracking rollers 11 and 17 in order to present a flat uniform surface to be coated and cured.

The substrate 10, coated with the uncured, wet film 15 of coating moves into the inert atmosphere chamber 20, through the entrance 21, where it first passes under leading jet 30, then under trailing jet 40 and finally under the radiation source 50 where the film 15 of coating composition is cured, before it emerges from the chamber 20, through exit 29. After it emerges from exit 29, the substrate 10 having the cured coating 15 thereon may be recoiled on re-wind reel 18 for shipping, or it may be fabricated by shaping, further coated or otherwise treated.

Figure 2:
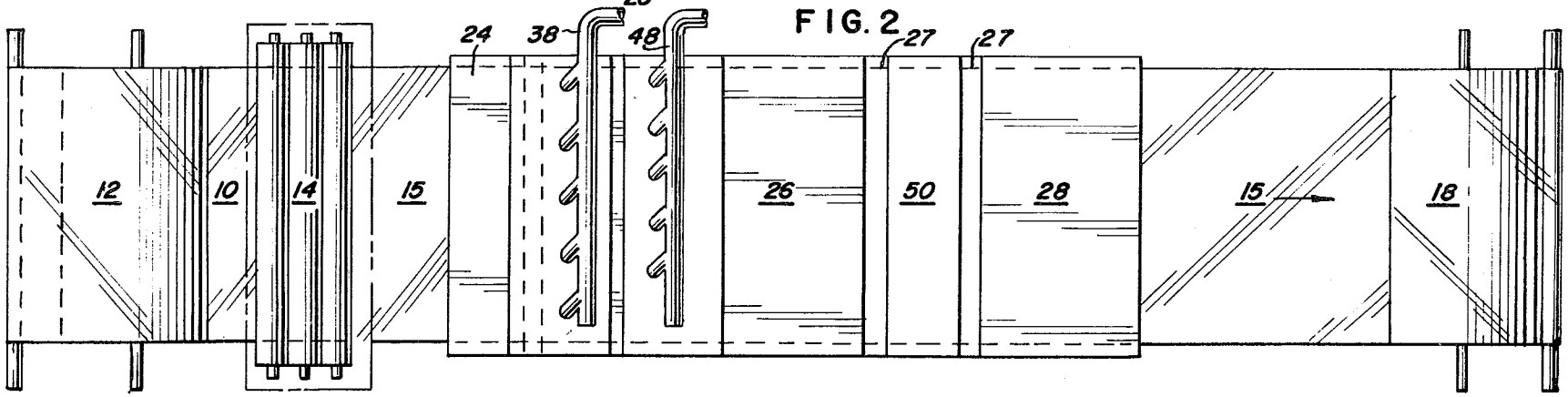
FIG. 2 is a top plan view of the schematic radiation curing operation shown in FIG. 1.

In the preferred embodiment of the invention the leading jet 30 is formed by an elongated opening or nozzle 31 which extends across the width of the coated substrate 15, as is clearly shown in FIG. 2. It is contemplated that the nozzle 31 may extend beyond the width of coated substrate 15 in order to accommodate any lateral shift in the coated substrate 15 during the operation.

The leading nozzle 31 structure includes interior chamber 32 which is fitted with a baffle plate 34 and a flow equalizing filter medium 36. Inert gas is fed to the chamber 32 by a plurality of openings from manifold 38, more clearly shown in FIG. 2. The pressure and flow rates of the incoming inert gas is controlled by valve 39.

In order to achieve the maximum inert gas effectiveness, it is essential to keep the jet of inert gas 30 emerging from nozzle 31 at a steady, non-turbulent or laminar flow with equal flow rates across the entire width of the inert atmosphere chamber. It has been found uniform flow may be accomplished by introducing the inert gas to the chamber 32 at a plurality of points across the width of the nozzle with a manifold device 38, whereupon the gas flow is dispersed and uniformly distributed by a baffle 34 placed under each input. The gas is further distributed by a pressure or flow rate equalizing filter medium 36 which is sufficiently impermeable so as to cause a pressure drop across its thickness. It has been found that compressed fiber glass batts, particles, filter paper and other materials may be used to form a suitable filter medium.

The construction of the nozzle 41 for trailing jet 40, is similar to that of the nozzle 31 for leading jet, in that it is supplied with an inert gas through valve 49, through manifold 48 and through the openings 47, around baffle 44, through filter medium 46, both of which are disposed within chamber 42. Although the trailing jet chamber 42 is depicted as being the same size as the leading jet chamber 32, this is not necessary and either of the jet chambers can be larger than the other. Generally speaking, the horizontal cross section area of the jet chambers 32 and 42 should be at least 4 times the cross sectional area of the jets 30 and 40 respectively, with a ratio of 10:1 being preferred. It is believed that these ratio will give jets of inert gas which are laminar rather than turbulent.

As is shown in FIG. 1, the leading nozzle 31 is angularly disposed to direct the jet of inert gas 30 from the interior of the chamber 32 downwardly and outwardly toward the entrance 21 of the inert chamber. The gas pressure within the chamber 32 is regulated with valve 39 combined with such design considerations as chamber geometry, shape and density of the filter medium, and configuration of the nozzle so that the velocity of the gas jet 30 acts as an "air knife" in that it blows the original air boundary layer, which is being carried by the moving coated surface, from the coated substrate, thereby removing most of the oxygen from the boundary layer at the interface of the coating composition and the atmosphere. The size of nozzle 31 and the angle at which it is disposed must be regulated to accomplish this washing action. The nozzle 31 is disposed as close as possible to the coated substrate 15 in order to minimize the volume of the inert chamber 20 and to maximize the penetration of the inert gas jet into the air boundary layer. As will be obvious to those skilled in the art, less inert gas is required to fill a smaller chamber at the same gas velocity. It is also desired to keep the gas velocity as low as possible in order to minimize disturbances of the coated film 15.

The lower surface trailing nozzle 41 is preferably disposed in the same plane as the lower surface of leading nozzle 31. Trailing jet 40 preferably emerges from a wide mouth, low-velocity nozzle 41 which is directed normal to the plane of the coated substrate 15. The function of the trailing jet 40 includes assisting leading jet 30 in removing the air boundary layer, adding to the entrainment of oxygen being pushed out of the chamber through opening 21, blanketing the coated substrate 15 and filling the chamber 20 with laminar, quiescent inert gas, moving in the same direction as the coated substrate. Since the oxygen will have been substantially removed by the action of the inert gas emerging from leading jet 30, the principle function of trailing jet 40 is to blanket the substrate with inert gas at a small positive pressure, thereby preventing leakage of oxygen into the chamber, such as from a back flow into exit 29.

The inert chamber 20, in addition to the jets 30 and 40, comprises side walls 22 which extend below the substrate 10 and may extend below the carrier means 16 if desired. Side walls 22 preferably join with bottom member 23 to form a gas tight seal. Although it is possible to use substrate 10 as the lower portion or bottom of the inert chamber 20 or in the case of substrates which are to be coated and cured on a carrier means which employs a full, solid belt, it is possible that no bottom member is required, it is generally preferred to employ a bottom member in order to avoid leakage of oxygen around the sides of the substrate or the carrier belt. It is contemplated that the use of a bottom member may also prevent extraneous gas flow which may disturb the established flow pattern in the atmosphere chamber 20.

Preferably the inert atmosphere chamber 20 contains a forward flange 24 which extends away from jet 30 in order to extend the length of the chamber 20. This flange 24, which extends over the width of the substrate 10 and wet coating 15, is in gas-tight relationship with side walls 22 and the housing for the leading jet 30, and thereby prevents air and/or oxygen from coming in contact with the coated substrate 10 during the washing of the substrate 10 and wet coating 15 with the inert gas emerging from jet 30. The required length of flange 24 is determined by the speed of the substrate 10, the size of the opening 21, and the velocity of the gas in jet 30, among other factors. The length of forward flange 24 should be about 2–6 inches, generally. The optimum length will be determined by each substrate, coating composition, and process combination.

The inert chamber 20 is also preferably equipped with a filler 25 which makes a gas-tight seal between the housing of the leading jet 30 and the housing of the trailing jet 40. The size of filler 25 may be varied in order to change the spacing between jets 30 and 40. Since the jets 30 and 40 introduce inert gas into the chamber 20 at a rate sufficient to cause a slight positive pressure therein, it is at least theoretically possible to operate without filler 25 or without one or the other of cover plates 26 and 28, described below. However, in order to operate with the minimum amount of inert gas it is generally preferable to use the filler 25 and cover plates 26 and 28 in order to minimize oxygen leakage into chamber 20, and extraneous flow.

The inert chamber 20 also is equipped with cover plates 26 and 28 which serve to maintain the gas tight integrity of the chamber 20. Said cover plate 26 may be fabricated as a portion of the housing for trailing jet 40, or as shown in FIG. 1, it may be made as a separate piece. Cover plates 26 and 28 and secondary window 27 function as the topmost members for the inert chamber 20, prevent seepage of air into chamber 20 and maintain a continuous flow passage prior to the substrate 10 and cured coating 15 emerging from exit 29. Cover plates 26 and 28 are preferably in gas tight engagement with side portions 22 and secondary window 27.

FIG. 1 shows the use of secondary window 27 which is in gas-tight contact with cover plates 26 and 28, as well as side portions 22. A secondary window 27 serves to exclude oxygen or air from the inert atmosphere chamber, while at the same time maintaining a continuous flow passage and preventing the escape of the inert atmosphere blanket which exits in chamber 20. It is contemplated that when curing coating compositions which are less sensitive to the presence of minor amounts of oxygen, secondary window 27 can be omitted. The secondary window may be made of any convenient material, but either aluminum foil or titanium foil is preferred. The secondary window may be joined to metallic screening which acts as a stiffener and heat sink for the heat generated in the secondary window. The double window set up causes more electron scattering than with a single window. For some purposes the electron scattering is helpful since it may result in more efficient curing or use of electrons. As will be known to those skilled in the art, aluminum alloy based windows tend to minimize this scattering, while titanium alloy windows tend to increase scattering.

Alternatively, it is possible under some conditions to move radiation source 50 downwardly to the point where it abuts the edges of cover plates 26 and 28 along with side portions 22, thereby defining a gas-tight seal. Under such circumstances one may elminate secondary window 27. It will be obvious to those skilled in the art that the closer the relationship between radiation source 50 and cover plates 26 and 28, the less chance there is for oxygen contamination in the vicinity of the cure. Therefore, when the secondary window 27 is eliminated or removed, it is preferred to space the radiation source as close as possible to chamber 20.

In designing the exact sizes of cover plate 26 and 28, it is necessary to consider the proximity of the radiation source 50 to the coating being cured. The opening under radiation source 50 with respect to the secondary window dimensions and the location of cover plates 26 and 28 is not less than the area of the usable electron beam or actinic radiation. In both cases the radiation is diverging when emitted from its source, thus the openings down stream of the primary window in the case of electron beam and the reflector in the case of actinic radiation must be larger than these dimensions. The angle of divergence will be particular to each device used. Generally it is desirable for cover plate 26 to extend as close as possible to the emitted radiation in order to exclude as much oxygen as is possible. The length of cover plate 28 is less critical since the coating on substrate 10 is generally fully cured by the time it passes under cover plate 28. Cover plate 28 must be long enough to insure undisturbed gas flow in the region of chamber 20 where the cure takes place.

It is preferrable that the elements which form the upper surface of the chamber be as planar as possible, since a continuous smooth surface is helpful in achieving laminar flow of the inert gas. Particularly when the inert chamber is to be used on an intermitent-continuous basis, it is preferred to eliminate any pockets in the upper surface of the chamber which can cause eddy currents or turbulence or which can hold pockets of air containing oxygen which may interfere with proper curing of the coating. Similarly, it is preferred that the jet chambers 32 and 42 be constructed with rounded corners to insure proper laminar flow and to prevent gas pockets, as will be understood by those skilled in the art.

Figures 4, 5, 6, 7, 8:
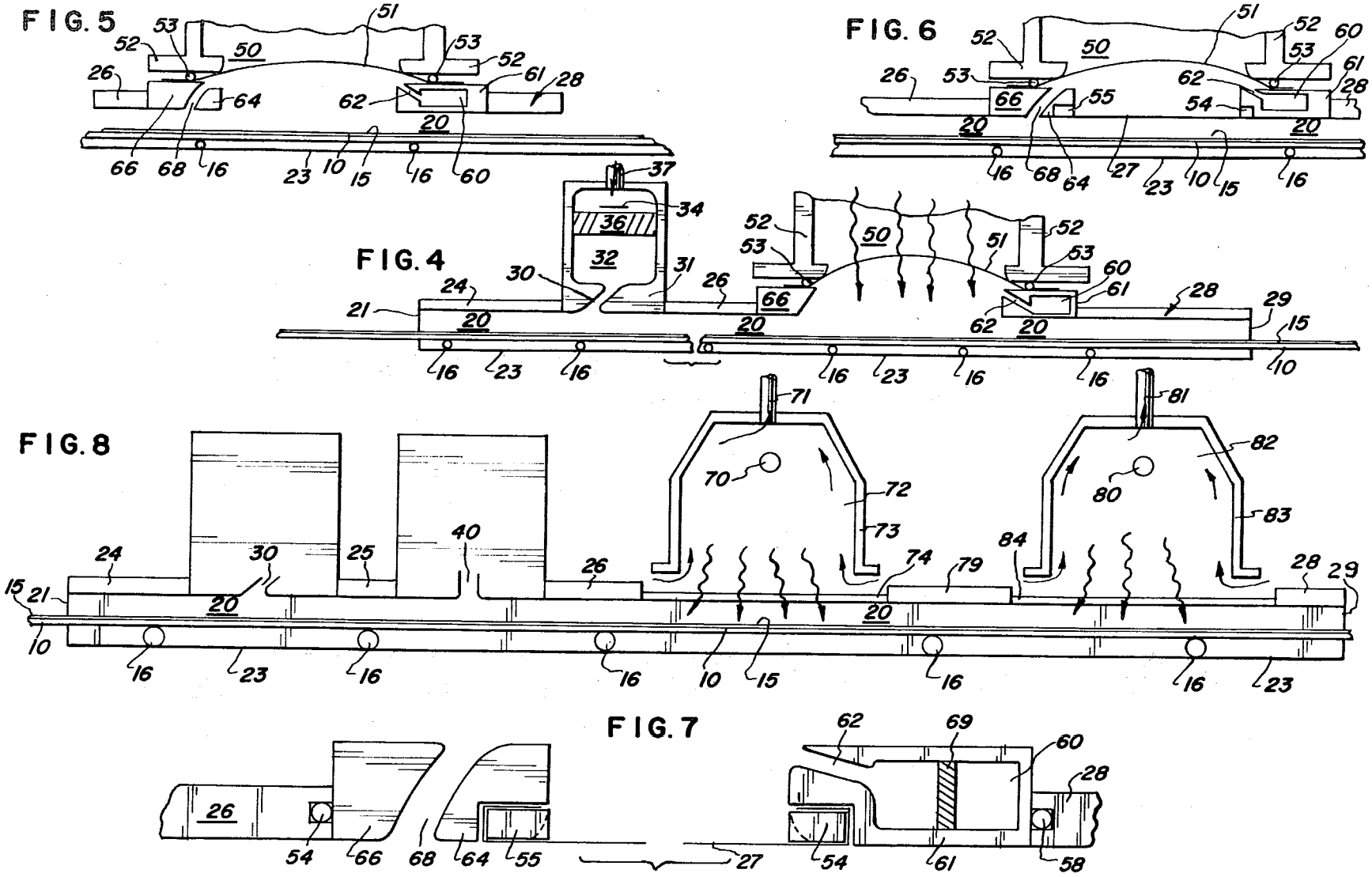
FIG. 4 is a side elevational view of the inert atmosphere chamber illustrating a single jet and the window of the electron beam cooled by inert gas.
FIG. 5 is a side elevational view of a portion of the inert atmosphere chamber showing the electron beam window with a modified deflection arrangement.
FIG 6 is a side elevational view of a portion of the inert atmosphere chamber showing the electron beam window with a primary and a secondary window, wherein the primary window and the secondary window are cooled with an inert gas.
FIG. 7 is a side elevational view shown in detail the arrangement of the secondary window of FIG. 6.
FIG. 8 is a side elevational view of a radiation curing operation schematically illustrating the inert atmosphere chamber, with two jets shown in partial lines, and ultraviolet lamps as the source of actinic radiation.

FIG. 4 depicts an alternative embodiment of the atmosphere chamber of the present invention. It is known in the prior art that electron beam devices generate heat in the window through which the accelerated electron pass (some are entrapped). One of the means described in the prior art to cool such windows is by directing a high velocity air stream over the exterior surface thereof. In the alternative embodiment, the electron beam window 51 is cooled by the movement of inert gas over the outside surface of window 51. The same inert gas is then redirected to create an inert blanket over the substrate. The inert gas thus fulfills a double function in that it is first used as a heat sink, and then used to exclude oxygen from the vicinity of the coating to be cured, and it is obvious that economies can be achieved.

This embodiment of the invention will be more clearly understood from the details of FIG. 4 wherein the evacuated portion of the electron beam accelerator 50 is within the housing terminated by flanges 52 and the window 51. The window 51 is usually an aluminum alloy; although it may be an alloy of titanium or other materials. The composition of the window is not a basic part of the present invention and it only need be capable of passing the majority of radiation from the radiation source. The window is in gas-tight contact (vacuum capable of $10^{-6}$ to $10^{-9}$ torr) with the flanges 52 and may be conveniently held in place by a gasket or seal 53 or other similar sealing device located between flanges 52 and members 61 and 66. In actual practice, it has been found expedient to make members 61 and 66 as a single piece unit with side members (not shown) to form a frame. Those skilled in the art will appreciate that the members 61 and 66 may also be separate parts. Inert gas from a source (not shown) is fed into the plenum 60, which extends the length of member 61 across the width of the electron beam device and may conveniently be an integral part of member 61. From plenum 60, the inert gas is distributed through a plurality of nozzles 62, or one single elongated nozzle, under pressure, and is directed against and across the window 51, where it absorbs a portion of the heat being generated in the window by the electrons from the beam passing through it. The gas moves across the surface of the window 51 where it is redirected downwardly by member 66. It will be obvious to those skilled in the art that the shape of member 66 will influence the direction, and to some extent the speed of the inert gas being deflected down onto the coated substrate.

As illustrated in FIG. 4, the inert gas which first functions as the cooling gas for window 51, simply replaces the trailing jet 40 in the embodiment shown in FIG. 1. FIG. 4 illustrates the preferred jet arrangement wherein a normal jet (as described herein) is used as the leading jet, while the trailing jet is supplied with gas which has been used to cool the electron beam window. It will be obvious to those skilled in the art that further modifications are possible in that the leading jet may be eliminated under some conditions.

The embodiment illustrated by FIG. 4 has a secondary advantage, in addition to the economy of inert gas, in that the accelerated electrons passing out of chamber 50 onto coated substrate 15 do not encounter any significant oxygen during their passage, except such oxygen as may be present as impurities in the inert gas. As is known in the prior art some forms of radiation, and particularly accelerated electrons from electron beam devices, when passing through air or other oxygen containing gas, collide with the oxygen molecules forming ozone. The embodiment shown in FIG. 4 minimizes the formation of ozone. In addition to be a pollutant, ozone is highly corrosive in that it oxidizes many materials such as steel at a very high rate.

Although it is not illustrated in FIG. 1 or FIG. 4, it has been found that suitable quantities of inert gas may be conveniently stored as liquids in cryogenic storage facilities. When the inert gas is needed, sufficient liquid nitrogen, for instance, is heated enough to vaporize the nitrogen and heat it to the desired temperature. This gives a measure of temperature control as to the inert gas which is fed into the inert chamber 20, which may be useful at times. For instance, if the coating composition being cured contains volatile components, the loss of these components may be diminished by decreasing the temperature of the inert gas being fed to chamber 20. The same measure of control of temperature may be excercised in the embodiment illustrated by FIG. 4 and to some extent more efficient cooling of the window 51 may be obtained. Further, by virtue of more efficient cooling of the window 51, it is possible to increase the electron beam accelerator's performance by permitting a higher total usable electron beam current.

FIG. 5 illustrates a variation of the embodiment of FIG. 4. Similar to FIG. 4, in FIG. 5 the inert gas enters plenum 60 where it is directed through nozzle 62 across window 51 for cooling purposes. The gas is then redirected through nozzle 68 which is formed by members 66 and 64. The geometry of members 64 and 66 may be varied so that the inert gas may be deflected in the desired direction. Nozzle 68 may be one elongated opening or may take the form of a plurality of openings.

FIG. 6 illustrates a further variation on the embodiment of FIG. 4 in that it employs a secondary window 27 similar to that shown in FIG. 1. The use of a secondary window 27, as is shown in FIG. 6, is preferred over the embodiment of FIG. 4 or of FIG. 5 since the presence of such a window tends to promote laminar flow of the inert gas in the chamber 20. When the secondary window is employed, it is necessary to provide means, such as nozzle 68 for the inert gas to be fed into the inert chamber proper. In this embodiment, the geometry of the nozzle 68 may be varied widely to accomplish variations on the inert gas flow, both with respect to its direction and speed.

FIG. 7 shows an enlarged view of the modification of FIG. 6 and shows in detail secondary window frame rails 54 and 55 which are used to mount secondary window 27 to the main portion of the cooling head, members 61 and 64. The frame on which the secondary window is mounted may be of one piece construction, or may be made from a plurality of pieces as illustrated. Advisedly, rails 54 and 55 are constructed so as to hold secondary window 27 under tension, thereby taking up any slack which might occur when its temperature increases. This helps to keep the upper surface of chamber 20 planar, thus promoting laminar flow of the inert gas within the chamber 20.

FIG. 7 also illustrates a modified plenum 60 within member 61, in that it contains a baffel-filter medium 69 which divides plenum 60 into a supply plenum and a secondary plenum in order to promote more even, uniform gas flow through nozzle 62.

FIG. 8 illustrates the inert atmosphere chamber of the present invention fitted with two mercury vapor ultraviolet lamps as a source of actinic radiation. In this arrangement, the jets 30 and 40 as well as the carrier mechanism 16, cover plates 26 and 28 and forward flange 24 are substantially the same as is illustrated in FIG. 1. The radiation source for FIG. 8 is a pair of ultraviolet lamps 70 and 80 which are mounted in tandem over chamber 20. The ultraviolet lamps 70 and 80 are surrounded by optical reflectors 73 and 83, which reflect the radiation downwardly through windows 74 and 84. The purpose of the windows 74 and 84 is similar to that of secondary window 27 shown in FIG. 1, namely to keep out oxygen and to promote laminar flow within chamber 20, but to permit the radiation to pass through. Preferably reflectors 73 and 83 are vented through exhaust ports 71 and 81, so that air entering the reflectors 73 and 83 can be used to sweep out any ozone generated in spaces 72 and 82, while at the same time, cooling the lamps 70 and 80. Divider plate 79 which is in gas tight relationship with the sides of chamber 20 and windows 74 and 84, is used to separate the radiation sources by an appropriate distance. The present invention contemplates the use of more than two ultra violet lamps and as many as six or more may be used.

Figure 10:
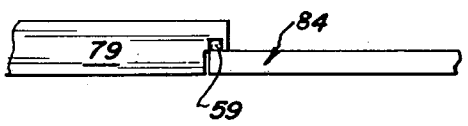
FIG. 10 is a side elevational view, in section, a modified joint similar to that shown in FIG. 8.
Figure 9:
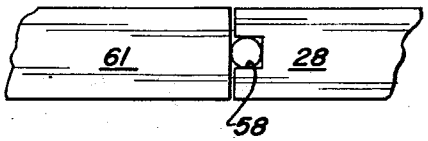
FIG. 9 is a side elevational view, in sections, of a joint suitable for providing gas tight connections between the units which make up the inert atmosphere chamber.
Figure 3:
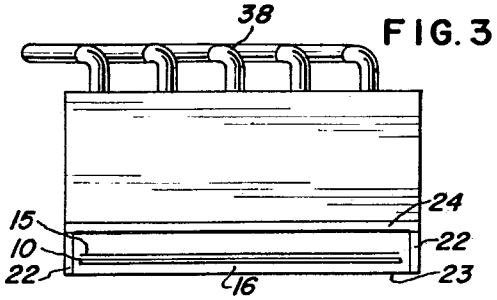
FIG. 3 is an end view of the inert atmosphere chamber, taken at section 3—3 of FIG. 1.

FIGS. 9 and 10 illustrate the preferred means of joining the various members which make up the inert atmosphere chamber 20, in that the members contain a grommet or gasket 58 and 59 which gives a gas tight seal between the members being joined. FIG. 9 shows the joint between member 61 and cover plate 28, while FIG. 10 illustrates the joint between divider plate 79 and window 84. The latter joint has provisions for expansion of window 84 as it heats up.

The following example will serve to illustrate the use of the inert atmosphere chambers of the present invention, but it is understood this is set forth merely for illustrative purposes and that many other operation conditions are suitable and are within the scope of the present invention.

EXAMPLE 1

Sheets of 15 mil steel, approximately 30 inches by 24 inches, were coated with 0.7 mils of a 100% convertible coating composition which is a reaction product of a polyether polyol, toluene diisocyanate, and hydroxyethyl acrylate dissolved in an acrylate monomer. The inert, chamber, as shown in FIG. 1, was operated using substantially pure nitrogen from a liquid nitrogen storage facility as the inert gas fed to valves 39 and 49. The pressure, as measured at the manifold, was about 2.0 psi for 38 and about 2.0 psi for 48. These pressures caused about 50 cubic feet per minute (measured at standard conditions) to make up each jet. The leading jet 30 had a velocity of about 20 feet per second. The opening (item 21 in FIG. 1) to the inert chamber, above the surface of the substrate was 0.25 inches. The nozzle 31 of the jet 30 was ¼ inch and was set at 45° from the horizontal. The width of the jets and the carrier mechanism (item 16 in FIG. 1) was 24 inches. The nozzle 41 for trailing jet 40 had a throat dimension of ¼ inch. Forward flange 24 extended about 2 inches ahead of the housing for jet 30. Rear flange 25 was about 2½ inches long. Cover plates 26 and 28 were 4 inches by 24 inches in size.

The electron beam was manufactured by High Voltage Engineering and would produce 300,000 electron volts (300Kev). It was set to give an absorbed dose of 1 megarad, while passing the substrate under at a speed of 175 feet per minute.

The coated substrate was passed into the inert chamber and under the electron beam at a rate of 175 feet per minute. Atmosphere sampling was conducted when the substrate was being moved through the inert atmosphere chamber. None of the samples taken within the chamber showed an oxygen concentration exceeding 0.05% by weight. As the substrate emerged from opening 29, testing showed that the coating composition had formed a tack-free, hard, solvent-resistant film and that the substrate could be immediately subject to further processing, including deformation of the coating composition without fear of it blocking or otherwise being damaged. When cured in the same accelerator with the same beam parameters but no inert chamber, the coating was tacky at radiation dosages as high as 10 megarads.

The mechanism for applying the coating 14, forms no particular part of the present invention. The coating apparatus may be used to coat all or part of one side of the substrate, or it may be set up to coat more than one side. Many types of conventional equipment can be used, such as roller coating, doctor blade, spraying and the like.

The particular form of the carrier means will be determined by the substrate to be coated. Said carrier means 16, may take the form of rollers, as is illustrated schematically in FIG. 1, which are satisfactory for use with substrates which are sufficiently large and rigid. Alternatively the carrier means 16 may take the form of a conveyor using either a solid or web belt to convey the substrate. For conveyor systems which employ a continuous solid belt it is preferred that a single continuous belt be located within chamber 20, and auxiliary belts be located ajacent to both ends of the interior belt in order to minimize the amount of oxygen being carried into the inert atmosphere chamber 20. Similarly, the carrier means can be varied over wide limits to include various types of conveyers including web conveyers, belt conveyers, and monorails.

The processing to which the substrate is subjected after the coating and curing in the inert atmosphere chamber of the present invention forms no part of the invention and no limits are imposed thereon.

As was noted above, the two jet concept generally described by FIGS. 1–4 is generally preferred since it gives a great deal of flexibility as to the types of substrates which may be effectively handled, the rate at which they may be cured, and the type of coating compositions which may be effectively cured. However, in some situations the inert atmosphere chamber will only handle a single given type of substrate, such as for example coiled metal of a standard width, the operating variables may be reduced to an absolute minimum and it is possible to operate effectively with a single jet. In such situations the trailing jet, may be operated at a somewhat higher pressure than that used in two jet operations but with less flow (volume) than that required for the combined flow (volume) of two jets and can satisfactorily displace the original air boundary layer, and essentially remove the oxygen from the interface of the coating and the atmosphere. Operating under such conditions, the output from the jet is also sufficient to blanket the substrate and fill the chamber with inert gas. Naturally, when such an apparatus is used, the leading jet need not physically be present, but the front flange 24 is preferably extended much further forward than it would in a case in which the leading jet 30 is employed. Both jets may be physically in place and only one used for some combinations of chemistry and substrate. Similar modifications can be employed in case of the embodiment shown in FIG. 4.

The present invention also contemplates the use of multiple jets to remove the oxygen from the boundary layer of irregularly shaped objects. For instance, it is contemplated that multiple jets oriented in different directions could be used to wash the oxygen away from automotive parts or components which are in the form of multi-dimensional multi-planar objects. In such cases a plurality of jets would preferably be employed and it is contemplated that as many as four or five jets could be used. It is further likely that several jets of the leading jet type would be employed, whereby the coated pieces would be washed with inert gas from several directions or different angles and possibly at different points in their progress through the chamber. It is contemplated that one or more of the jets used in this embodiment could be operated at Reynold's numbers in the range of turbulent flow. Following the washing operation they could be conveniently blanketed with inert gas at relatively low pressure, again similar to the FIG. 1 embodiment, wherein the trailing jets would principably blanket the washed substrate with inert gas at a pressure sufficient to avoid oxygen leakage thereon.

FIG. 1 illustrates a pressure equalizing filters 36 and 46 as being used to equalize the pressure across the interior of the jet chambers 32 and 42. It has been found that several batts, up to five one inch batts of fiber glass, if compressed into a frame approximately the size of the chamber 32 provides a usable filter medium. It will be obvious to those skilled in the art that other porous materials may also be used. The present invention contemplates various materials of construction in producing the jets and flanges and the like. Generally they may be fabricated out of any convenient material. For instance mild steel and aluminum have been found to be easy to fabricate and sufficiently durable for use.

It will be obvious to those skilled in the art the configuration of the inert atmosphere chamber can be varied. For instance, the height between the carrier means and the jets can be adjustable by moving either of the jets or the carrier means. The present invention contemplates pivotally mounting forward flange 24 (as well as cover plate 28) so that it may be inclined downwardly to reduce the size of opening 21 (and exit opening 29). The present invention also contemplates the use of side walls 22 which are moveable inwardly in order to reduce the width of the chamber 20 when coated substrates of less than the maximum width are being cured.

The present invention also contemplates the use of one or more trailing jets and in the case of ultraviolet light radiation sources one of such trailing jets (or the sole trailing jet) may be located between the radiation sources, rather than ahead of the radiation sources, as shown in FIG. 8.

The radiation contemplated by the present invention is not limited to any precise type of radiation nor is the present invention limited to any particular form of radiation generation means. As is described herein the preferred embodiment of the invention employs an electron beam to produce ionizing radiation but other means of providing ionizing radiation such as linear accelerators, Van der Graff generators and isotopes, such as cobalt 60, are contemplated. Similiarly, various types of ultraviolet sources may be used to generate actinic radiation. Other types of radiation and means for producing such radiation will be known to those skilled in the art.

Although the radiation source is shown as being normal to the surface of the substrate, it is contemplated that the radiation source may be angularly disposed in order to effectively increase the length of the electron travel through the coating being cured.

Although all of the drawings illustrate a horizontally disposed substrate moving under a vertically disposed radiation source, it will be obvious to those skilled in the art that other physical arrangements may be used. For instance the substrate may be vertical and the radiation source may be horizontal. Such an arrangement may be useful in treating substrates which are coated and cured on both sides relatively simultaneously.

The apparatus of the present invention may be used with any type of inert gas or mixture of inert gases. While nitrogen is generally preferred, for using the practice of the present invention because of its availability and relatively low price, other gases such as helium, argon, carbon dioxide, hydrocarbons and combustion gases may be used. Further, nitrogen is preferred for ecology considerations, since the release of relatively pure nitrogen into the air does not harm the ecollogy.

The forms of invention herein shown and described are to be considered only as illustrative. It will be apparent to those skilled in the art that numerous modifications may be made therein without departure from the spirit of the invention or the scope of the appended claims.

We claim:

1. An inert atmosphere chamber for use in connection with a process for continuously, or semi-continuously curing under the influence of radiation, and oxygen-sensitive, radiation curable surface coating compositions on substrates including a chamber housing comprising side walls and a top portion, radiation means adjacent said chamber housing for curing said radiation curable substrates, transport means to transport said coated substrate through said chamber, a first inert gas nozzle positioned within said chamber housing before said radiation means and extending substantially across the width of said chamber housing and above said coated substrate, said first nozzle adapted to direct a uniform jet of inert gas against said coated substrate as said coated substrate passes through said chamber housing whereby the original air boundary layer is blown off and removed from said coated substrate prior to curing of said radiation curable coating by said radiation means.

2. A chamber as described by claim 1, which comprises a bottom portion for said chamber.

3. A chamber as described by claim 1, wherein said radiation means is an electron beam accelerator.

4. A chamber as described by claim 1, wherein said radiation means is an ultraviolet light lamp.

5. A chamber as described in claim 1, wherein the inert gas is introduced through a single nozzle.

6. A chamber as described in claim 1, which comprises a second nozzle adapted to provide inert gas to replace the original air boundary layer removed by said first inert gas nozzle.

7. A chamber as described in claim 1, wherein said first gas nozzle jet is angularly disposed to said coated substrate to thereby remove the air boundary layer from said coating surface as said coated substrate passes through said chamber housing.

8. A chamber as described in claim 7 wherein said leading jet is disposed at an angle between about 30° and 60°.

9. A chamber as described in claim 7, which comprises a second jet which is located between said leading jet and said radiation means and adapted to blanket said coated substrate with inert gas.

10. A chamber as described in claim 1, wherein the inert gas consists essentially of nitrogen.

11. A chamber as described in claim 3, wherein said chamber housing includes a window for said electron beam accelerator and said inert gas is used to said window for said electron beam accelerator, and said inert gas is then used to fill said inert atmosphere chamber.

12. Apparatus for in-line irradiation treatment of a moving product comprising:

A first and second tunnel of substantially uniform cross section each having an inlet end and an outlet end;

a treating chamber having at least one treating source mounted therein, said chamber being located intermediate the outlet end of said first tunnel and the inlet end of second tunnel; and means for maintaining a substantially inert atmosphere at the surface of said moving product comprising an elongated gas injector channel having a first open end communicating with said enclosure and located intermediate said first tunnel opening and said treatment chamber said first open end having a length at least substantially equal to the width of said product with the longer axis of said opening directed substantially parallel to the width of said first tunnel; a plenum chamber connected to a second open end of said channel; and a source of inert gas for continuously introducing inert gas into said plenum chamber.

13. Apparatus as defined in claim 12 wherein said gas injector channel is spatially oriented to direct said inert gas toward said product at an included angle of about 45° with respect to the longitudinal exis of said enclosure.

14. Apparatus as defined in claim 13 wherein said gas injector channel is the sole means for introducing inert gas into said enclosure.

15. Apparatus as defined in claim 14 wherein the first open end of said channel is disposed in relatively close proximity to said moving product.

16. Apparatus as defined in claim 15 wherein said gas injector channel is a slotted groove formed in the upper wall of said first tunnel and has parallel side faces.

17. Apparatus as defined in claim 16 wherein said injector channel has a height at least four times greater than the channel width.

18. Apparatus as defined in claim 17 wherein said first and second tunnels have a cross-sectional geometry substantially conforming to the cross-sectional geometry of said product.

19. Apparatus as defined in claim 18 wherein the smallest cross-sectional area of said plenum chamber is at least about ten times greater than the longitudinal cross-sectional area of said channel.

20. Apparatus as defined in claim 19 wherein said inert gas is nitrogen.

21. Apparatus as defined in claim 20 wherein the cross-sectional geometry of said channel substantially conforms to the cross-sectional geometry of each of said first and second tunnels.

22. Apparatus as defined in claim 21 wherein said enclosure has a bottom planar surface upon which the product passes representing the bottom side of said first tunnel, said treating chamber and said second tunnel respectively.

23. Apparatus as defined in claim 21 wherein said product is a continuous web which once extended through said enclosure forms the bottom surface thereof.

* * * * *